US008485632B2

(12) United States Patent
Park et al.

(10) Patent No.: US 8,485,632 B2
(45) Date of Patent: Jul. 16, 2013

(54) INKJET HEAD AND METHOD OF MANUFACTURING THE SAME

(75) Inventors: Chang Sung Park, Gyunggi-do (KR); Jae Woo Joung, Gyunggi-do (KR); Ji Han Kwon, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 718 days.

(21) Appl. No.: 12/654,528

(22) Filed: Dec. 22, 2009

(65) Prior Publication Data

US 2011/0043564 A1 Feb. 24, 2011

(30) Foreign Application Priority Data

Aug. 24, 2009 (KR) ..... 10-2009-0078346

(51) Int. Cl.
*B41J 29/38* (2006.01)
*B41J 29/377* (2006.01)
*B41J 2/05* (2006.01)

(52) U.S. Cl.
USPC ..... 347/18; 347/17; 347/65

(58) Field of Classification Search
USPC ..... 347/17, 18
See application file for complete search history.

(56) References Cited

U.S. PATENT DOCUMENTS

| | | | | |
|---|---|---|---|---|
| 2004/0155943 | A1 | 8/2004 | Kim et al. | |
| 2006/0139419 | A1 * | 6/2006 | Shigemura | 347/85 |
| 2007/0195126 | A1 | 8/2007 | Kusunoki | |
| 2009/0066758 | A1 | 3/2009 | Von Essen et al. | |
| 2010/0220141 | A1 | 9/2010 | Ozawa | |

FOREIGN PATENT DOCUMENTS

| | | |
|---|---|---|
| JP | 2002-248746 | 9/2002 |
| JP | 2004-237734 | 8/2004 |
| JP | 2006-7498 | 1/2006 |
| JP | 2007-223146 | 9/2007 |
| JP | 2008-279727 | 11/2008 |
| KR | 10-2007-007414 A | 7/2007 |

OTHER PUBLICATIONS

Korean Office Action issued May 2, 2011 in corresponding Korean Patent Application 10-2009-0078346.
Japanese Office Action mailed May 29, 2012 issued in corresponding Japanese Patent Application No. 2009-293356.

* cited by examiner

*Primary Examiner* — Uyen Chau N Le
*Assistant Examiner* — Kajli Prince

(57) ABSTRACT

An inkjet head according to an aspect of the invention may include: a flow path plate having a plurality of ink chambers; a nozzle plate having a plurality of nozzles connected to the ink chambers in order to eject ink in the ink chambers to the outside; and a temperature control unit having a heat exchange passage in at least one of the flow path plate and the nozzle plate in order to control temperature of the ink.

11 Claims, 3 Drawing Sheets

INKJET HEAD AND METHOD OF MANUFACTURING THE SAME

CROSS-REFERENCE TO RELATED APPLICATIONS

This application claims the priority of Korean Patent Application No. 10-2009-0078346 filed on Aug. 24, 2009, in the Korean Intellectual Property Office, the disclosure of which is incorporated herein by reference.

BACKGROUND OF THE INVENTION

1. Field of the Invention

The present invention relates to an inkjet head and a method of manufacturing the same, and more particularly, to an inkjet head that can improve printing quality and a method of manufacturing the same.

2. Description of the Related Art

In general, an inkjet head converts an electric signal into a physical force so that ink droplets are ejected through small nozzles.

In recent years, piezoelectric inkjet heads have been used in industrial inkjet printers. For example, a circuit pattern is directly formed by spraying ink prepared by melting metals such as gold or silver onto a printed circuit board (PCB). A piezoelectric ink et head is also used for industrial graphics, and is used in the manufacturing of a liquid crystal display (LCD) and an organic light emitting diode (OLED).

In general, an inlet and an outlet through which ink is introduced and ejected in a cartridge, a reservoir storing the ink being introduced, and chambers through which a driving force of an actuator by which the ink in the reservoir is moved to nozzles are provided in an inkjet head of an inkjet printer.

However, since the inkjet head according to the related art does not have a separate temperature control system therein, when high-speed vibrations occur in an actuator, heat is generated to thereby cause changes in the temperature of ink.

The changes in the temperature cause changes in the viscosity of ink and the surface tension ink, which lead to changes in the speed and volume of ink droplets being ejected. As a result, printing quality is deteriorated.

SUMMARY OF THE INVENTION

An aspect of the present invention provides an inkjet head that can increase printing quality by controlling the temperature of ink and a method of manufacturing the same.

According to an aspect of the present invention, there is provided an inkjet head including: a flow path plate having a plurality of ink chambers; a nozzle plate having a plurality of nozzles connected to the ink chambers in order to eject ink in the ink chambers to the outside; and a temperature control unit having a heat exchange passage in at least one of the flow path plate and the nozzle plate in order to control temperature of the ink.

A liquid refrigerant may circulate through the heat exchange passage of the temperature control unit.

A gas refrigerant may circulate through the heat exchange passage of the temperature control unit.

The heat exchange passage of the temperature control unit may surround the ink chambers.

The heat exchange passage of the temperature control unit may surround the nozzles.

The inkjet head may further include an intermediate plate arranged between the flow path plate and the nozzle plate and having dampers connecting the ink chambers and the nozzles.

The temperature control unit may surround the dampers.

According to another aspect of the present invention, there is provided a method of manufacturing an inkjet head, the method including: providing a flow path plate having an ink chamber and a nozzle plate having a nozzle; forming a recess defining a path surrounding at least one of the ink chamber and the nozzle; and forming a heat exchange passage in order to control temperature of ink by bonding the flow path plate and the nozzle plate with the recess.

The heat exchange passage may be formed to surround the ink chamber.

The heat exchange passage may be formed to surround the nozzle.

The forming of the heat exchange passage may be 2 recess through an etching process.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

An inkjet head and a method of manufacturing the same according to an exemplary embodiment of the invention will be described in detail with reference to FIGS. 1 through 6. Exemplary embodiments of the present invention will now be described in detail with reference to the accompanying drawings.

The invention may, however, be embodied in many different forms and should not be construed as being limited to the embodiments set forth herein. Rather, these embodiments are provided so that this disclosure will be thorough and complete, and will fully convey the scope of the invention to those skilled in the art.

Figure 1:
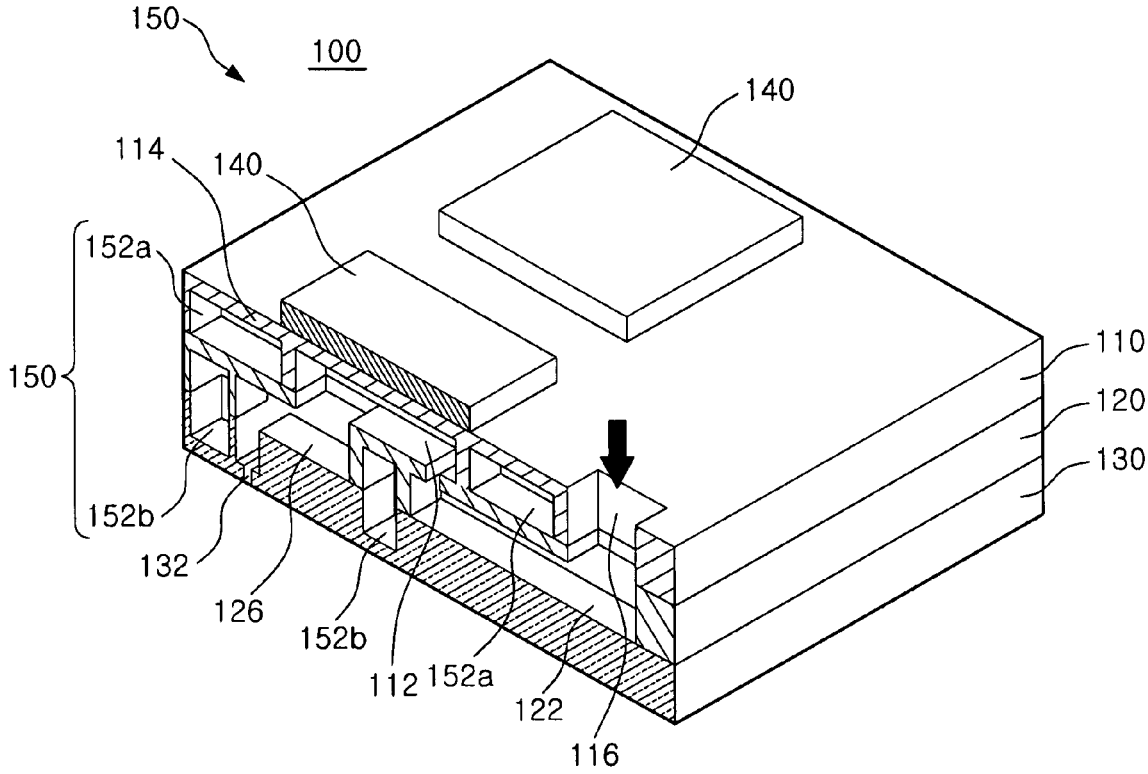
FIG. 1 is a schematic perspective view illustrating an inkjet head according to an exemplary embodiment of the present invention.
Figure 2:
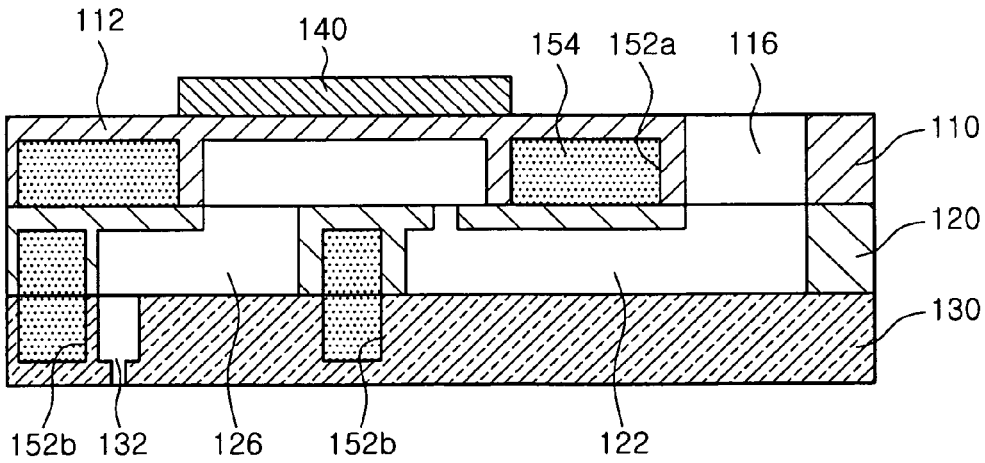
FIG. 2 is a cross-sectional view illustrating the inkjet head of FIG. 1.
Figure 3:
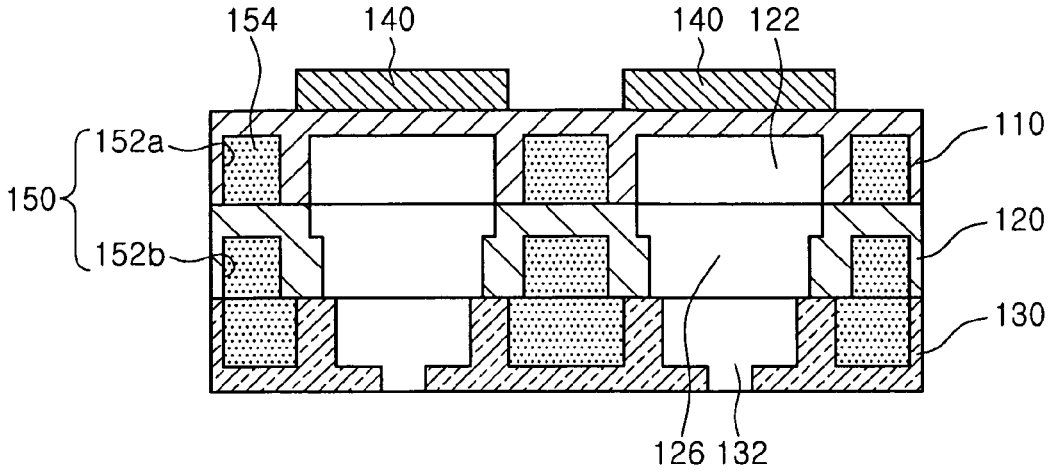
FIG. 3 is a side sectional view illustrating the inkjet head of FIG. 1.

FIG. 1 is a schematic perspective view illustrating an inkjet head according to an exemplary embodiment of the invention. FIG. 2 is a cross-sectional view illustrating the inkjet head of FIG. 1. FIG. 3 is a side sectional view illustrating the inkjet head of FIG. 1.

Referring to FIG. 1, an inkjet head 100 includes a flow path plate 110, an intermediate plate 120, a nozzle plate 130, and a temperature control unit 150.

A plurality of ink chambers 112 are formed in the flow path plate 110. An ink introduction hole 116 is provided in the flow path plate 110. Here, the ink introduction hole 116 is directly connected to a manifold 122. The manifold 122 supplies ink to the ink chambers 112 through a restrictor 124 (in the direction of the arrow).

Here, the manifold 122 may be one big space to which the plurality of ink chambers 112 are connected. However, the invention is not limited thereto. A plurality of manifolds 122 may be formed to correspond to the individual ink chambers 112.

Similarly, one ink introduction hole 116 may be formed to correspond to one manifold 122. When the plurality of manifolds 122 are formed, a plurality of ink introduction holes 116 may be formed to correspond to the individual manifolds 122.

The ink chambers 112 are provided in the flow path plate 110 at positions located under piezoelectric actuators 140. Here, a portion of the flow path plate 110 that forms the ceiling of the ink chambers 112 serves as a vibration plate 114.

Therefore, when a driving signal is applied to the piezoelectric actuators 140 in order to eject ink, the piezoelectric actuators 140 and the vibration plate 114 thereunder are deformed to reduce the volumes of the ink chambers 112.

Here, the reduction in the volumes of the ink chambers 112 increases the pressure inside the ink chambers 112, so that ink inside the ink chambers 112 is ejected to the outside through dampers 126 and nozzles 132.

Electrodes electrically connected to each other may be formed on upper and lower surfaces of each of the piezoelectric actuators 140. The electrodes may be formed of Lead Zirconate Titanate (PZT) ceramics, which is one of piezoelectric materials.

Here, the above space together with the temperature control unit 150 may be created in the flow path plate 110 by an etching process in order to form the ink chambers 112 and the ink introduction hole 116.

The intermediate plate 120 may include the manifold 122 having a large length extending in a longitudinal direction and the dampers 126 connecting the nozzles 132 and the ink chambers 112.

The manifold 122 is supplied with ink through the ink introduction hole 116 and supplies the ink to the ink chambers 112. The manifold 122 and the ink chambers 112 are connected with each other through the restrictor 124.

The dampers 126 receive the ink ejected from the ink chambers 112 through the piezoelectric actuators 140 and eject the received ink to the outside through the nozzles 132.

The dampers 126 may have a multi-stage configuration by which the amount of ink ejected from the ink chambers 112 and the amount of ink ejected through the nozzles 132 can be controlled.

Here, the dampers 126 are optional. When the dampers 126 are removed, the inkjet head only includes the flow path plate 110 and the nozzle plate 130.

The intermediate plate 120 may include the dampers 126 and the manifold 122 together with the temperature control unit 150.

The nozzle plate 130 corresponds to the ink chambers 112 and includes the nozzles 132 through which the ink passing through the dampers 126 is ejected to the outside. The nozzle plate 130 is bonded to the bottom of the intermediate plate 120.

The ink moving through a flow path formed inside the inkjet head is sprayed as ink droplets through the nozzles 132.

Here, silicon substrates being widely used for semiconductor integrated circuits may be used as the flow path plate 110, the intermediate plate 120, and the nozzle plate 130. However, the flow path plate 110, the intermediate plate 120 and the nozzle plate 130 are not limited to silicon substrates, and may be formed of various materials.

Figure 4:
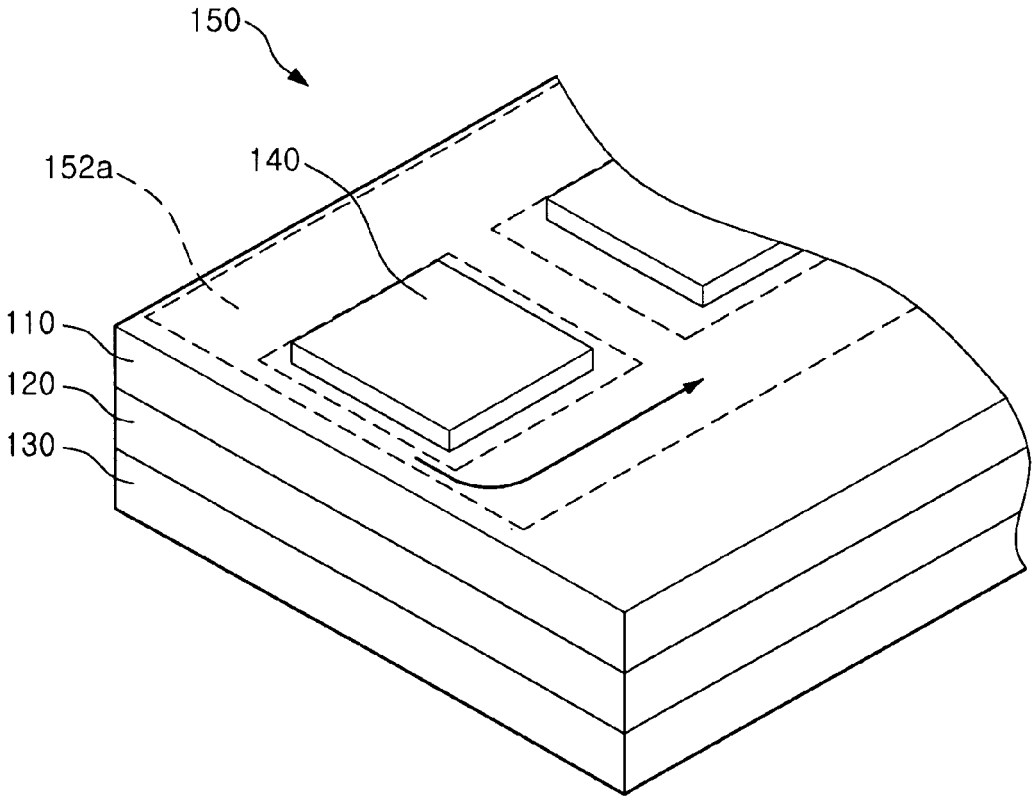
FIG. 4 is a sectional perspective view illustrating a temperature control unit of an inkjet head according to an exemplary embodiment of the present invention.

FIG. 4 is a sectional perspective view illustrating a temperature control unit of an inkjet head according to an exemplary embodiment of the invention.

Referring to FIG. 4, recesses may be provided in the temperature control unit 150 so that flow paths are formed in the flow path plate 110, the intermediate plate 120 and the nozzle plate 130.

The flow path plate 110, the intermediate plate 120 and the nozzle plate 130 are bonded to each other, thereby forming the temperature control unit 150 inside the inkjet head.

Here, the temperature control unit 150 includes heat exchange passages 152*a* and 152*b*, which are spaces inside the inkjet head, through which refrigerant circulates (in the direction of the arrow). Furthermore, the temperature of the ink can be controlled to desired temperature through the heat exchange passages 152*a* and 152*b*.

Here, a refrigerant may be a liquid, such as water having a low temperature. However, the invention is not limited. A gas refrigerant, such as air, helium or hydrogen, may be used. Alternatively, the refrigerant may be generally any of halocarbons, hydrocarbon, an organic compound, and an inorganic compound.

As shown in FIG. 2, the temperature control unit 150 may include the heat exchange passage 152*a* surrounding the ink chambers 112 so that refrigerant circulates around the ink chambers 112.

Further, the temperature control unit 150 may include the heat exchange passage 152*b* surrounding dampers 126 so that refrigerant circulates around the dampers 126.

Here, the dampers 126 may have a multi-stage configuration, and the heat exchange passage 152*b* may also have a multi-stage configuration correspondingly.

As for the inkjet head according to this embodiment, refrigerant may be used in order to prevent an increase in the temperature of the ink due to heat generated in piezoelectric actuators 140 during vibrations thereof. The stable state of the ink is ensured to thereby increase high frequency ink ejection characteristics and printing quality.

In this embodiment, the refrigerant may be used to reduce the temperature of the ink. However, the temperature control unit 150 may be designed to use hot water in order to increase the temperature of the ink according to the purpose of the inkjet head.

Figure 5:
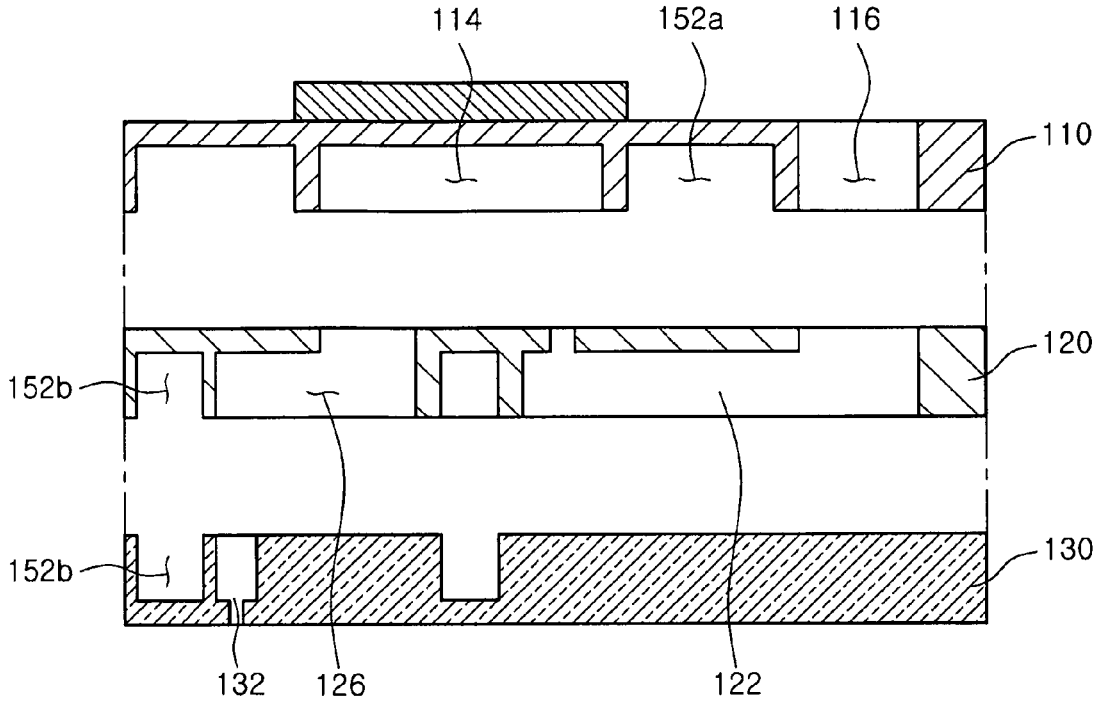
FIG. 5 is a cross-sectional view illustrating a method of manufacturing an inkjet head according to an exemplary embodiment of the present invention.

FIG. 5 is a cross-sectional view illustrating a method of manufacturing an inkjet head according to an exemplary embodiment of the invention.

Referring to FIG. 5, a method of manufacturing an inkjet head includes providing the flow path plate 110 and the nozzle plate 130.

In order to form the temperature control unit 150, the ink chambers 112 may be formed in one surface of the flow path plate 110, and the heat exchange passages 152*a* and 152*b* are formed in the nozzle plate 130.

The heat exchange passages 152*a* and 152*b* are formed by an etching process together with the ink chambers 112, the manifold 122, the dampers 126 and the nozzles 132.

The flow path plate 110 and the nozzle plate 130 are then bonded to each other to thereby form the temperature control unit 150 therein.

Here, the flow path plate 110, the intermediate plate 120 and the nozzle plate 130 are bonded to each other to form a single body. That is, the intermediate plate 120 is bonded to the bottom of the flow path plate 110, and the nozzle plate 130 is bonded to the bottom of the intermediate plate 120. However, the heat exchange passages 152*a* and 152*b* are formed in each layer, through which refrigerant is circulated.

Since the temperature control unit 150 may be formed between the ink chambers 112 and the ink introduction hole 116 through which ink is introduced, the transmission of vibrations from the piezoelectric actuator 140 to the ink introduction hole 116 can be prevented by the refrigerant circulating through the heat exchange passages.

Figure 6:
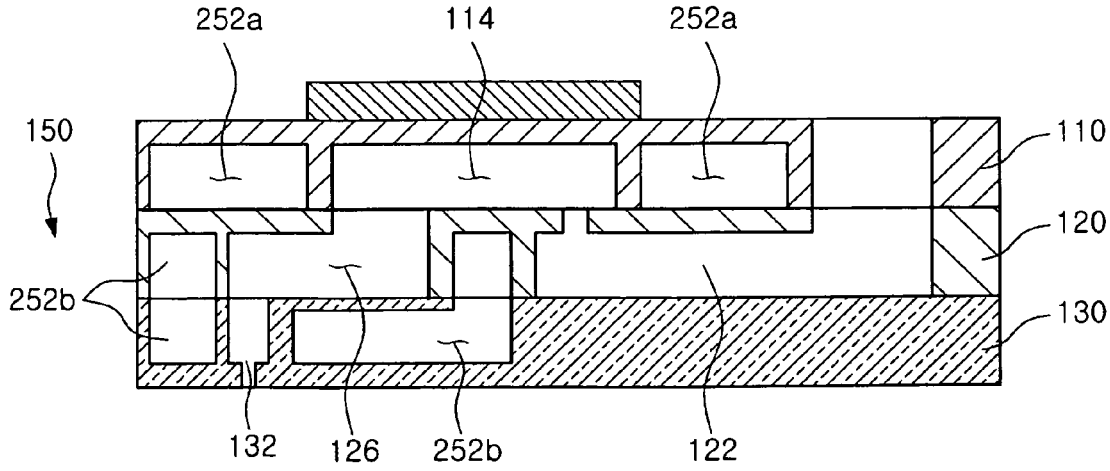
FIG. 6 is a cross-sectional view illustrating a temperature control unit of an inkjet head according to another exemplary embodiment of the present invention.

FIG. 6 is a cross-sectional view illustrating a temperature control unit of an inkjet head according to another exemplary embodiment of the invention.

Referring to FIG. 6, recesses may be formed in a temperature control unit 250 so that flow paths are formed in the flow path plate 110, the intermediate plate 120 and the nozzle plate 130.

As shown in FIG. 6, the temperature control unit 250 may include a heat exchange passage 252*a* surrounding the ink chambers 112 so that refrigerant circulates around the ink chambers 112.

The temperature control unit 250 may include a heat exchange passage 252*b* surrounding the dampers 126 so that refrigerant circulates through the dampers 126.

Here, the heat exchange passage 252*b* may have an L shape so that the refrigerant circulates around the nozzles 132 connected to the dampers 126.

Therefore, the heat exchange passage 252*b* according to this embodiment is formed around the dampers 126, is formed adjacent to the bottom of the dampers 126, and is formed so that the refrigerant circulates around the nozzles 132, thereby effectively controlling the temperature of the ink being ejected to the outside.

As set forth above, since an inkjet head and a method of manufacturing the same according to exemplary embodiments of the invention include a temperature control unit controlling the temperature of the ink to ensure the stable state of the ink, thereby increasing high frequency ink ejection characteristics and printing quality.

Furthermore, according to the inkjet head and the method of manufacturing the same, the temperature control unit formed adjacent to ink chambers and nozzles can prevent crosstalk affecting another chamber by preventing the transmission of vibrations from an actuator to another adjacent chamber.

While the present invention has been shown and described in connection with the exemplary embodiments, it will be apparent to those skilled in the art that modifications and variations can be made without departing from the spirit and scope of the invention as defined by the appended claims.

What is claimed is:

1. An inkjet head comprising:

a flow path plate having a plurality of ink chambers located under an actuator and at least one ink introduction hole configured for an ink to be introduced therethrough;

a nozzle plate having a plurality of nozzles connected to the ink chambers in order to eject ink in the ink chambers to the outside; and a temperature control unit having a heat exchange passage in at least one of the flow path plate and the nozzle plate in order to control temperature of the ink, the heat exchange passage formed between the ink chambers and the at least one ink introduction hole.

2. The inkjet head of claim 1, wherein a liquid refrigerant circulates through the heat exchange passage of the temperature control unit.

3. The inkjet head of claim 1, wherein a gas refrigerant circulates through the heat exchange passage of the temperature control unit.

4. The inkjet head of claim 1, wherein the heat exchange passage of the temperature control unit is further formed to surround the ink chambers.

5. The inkjet head of claim 1, wherein the heat exchange passage of the temperature control unit is further formed to surround the nozzles.

6. The inkjet head of claim 1, further comprising an intermediate plate arranged between the flow path plate and the nozzle plate and having dampers connecting the ink chambers and the nozzles.

7. The inkjet head of claim 6, wherein the temperature control unit is further formed to surround the dampers.

8. A method of manufacturing an inkjet head, the method comprising:

providing a flow path plate having an ink chamber located under an actuator and at least one ink introduction hole configured for an ink to be introduced therethrough and a nozzle plate having a nozzle;

forming a recess between the ink chamber and the at least one ink introduction hole; and forming a heat exchange passage in order to control temperature of ink by bonding the flow path plate and the nozzle plate with the recess.

9. The method of claim 8, wherein the heat exchange passage is further formed to surround the ink chamber.

10. The method of claim 9, wherein the heat exchange passage is further formed to surround the nozzle.

11. The method of claim 8, wherein the forming of the heat exchange passage is performed by forming the recess through an etching process.

* * * * *